United States Patent [19]

Kume et al.

[11] 4,439,771

[45] Mar. 27, 1984

[54] GLASS ANTENNA SYSTEM FOR AN AUTOMOBILE

[75] Inventors: Masaharu Kume, Tokyo; Kenichi Ishii; Takayasu Hokusho, both of Yokohama, all of Japan

[73] Assignee: Asahi Glass Company, Ltd., Tokyo, Japan

[21] Appl. No.: 378,329

[22] Filed: May 14, 1982

[30] Foreign Application Priority Data

May 15, 1981 [JP] Japan ..... 56-72913

[51] Int. Cl.[3] ..... H01Q 1/32; H01Q 1/02

[52] U.S. Cl. ..... 343/704; 343/713; 219/203; 219/522

[58] Field of Search ..... 219/203, 522, 543; 343/704, 713

[56] References Cited

U.S. PATENT DOCUMENTS

| | | | |
|---|---|---|---|
| 3,971,029 | 7/1976 | Torii et al. | 343/704 |
| 4,063,247 | 12/1977 | Sukurai et al. | 343/704 |
| 4,086,594 | 4/1978 | Kropielnicki et al. | 343/704 |
| 4,095,228 | 6/1978 | Meinke et al. | 343/704 |
| 4,155,090 | 5/1979 | Kuroyanagi et al. | 343/713 |
| 4,260,989 | 4/1981 | Ishii et al. | 343/704 |

FOREIGN PATENT DOCUMENTS

| | | | |
|---|---|---|---|
| 2746419 | 5/1978 | Fed. Rep. of Germany | 343/704 |
| 1445532 | 8/1976 | United Kingdom . | |
| 2019100 | 10/1979 | United Kingdom . | |

*Primary Examiner*—Volodymyr Y. Mayewsky
*Attorney, Agent, or Firm*—Oblon, Fisher, Spivak, McClelland & Maier

[57] ABSTRACT

A glass antenna system for an automobile comprises a main antenna disposed at an upper part of a glass plate for a rear window of the automobile and a defogging electric heating element disposed below and separate from the main antenna and comprising a plurality of heating strips and a pair of bus bars for supplying electricity to the heating strips. The glass antenna system is characterized in that a lead wire is connected to a predetermined portion of the lower most heating strip among said heating strips and a feeding point for connection to an antenna feeder line is provided on the lead wire, whereby the defogging electric heating element constitutes a subsidiary antenna having a directivity different from the directivity of the main antenna.

7 Claims, 16 Drawing Figures

GLASS ANTENNA SYSTEM FOR AN AUTOMOBILE

BACKGROUND OF THE INVENTION

1. Field of the Invention

The present invention relates to a glass antenna system for an automobile, which is most suitable for use in a diversity antenna system wherein a plurality of antennas are switchable optionally from one to another.

2. Description of the Prior Art

A glass antenna comprising antenna strips formed on or in a window glass of an automobile has become widely used as an antenna for a radio receiver in an automobile. In such a glass antenna, there has been an improvement of the pattern of the antenna strips or an improvement of an amplifier, a choke coil, a capacitor, etc. which are associated with the antenna, and there are available some glass antennas having superior non-directivity or sensitivity. For instance, a glass antenna 6 as shown in FIG. 1 is used for an automobile as an antenna having superior sensitivity to a FM broadcast wave since it has minimum horizontal directivity when it receives a horizontally polarized wave of the FM broadcast band, wherein there are formed on the surface of a glass plate 5, an asymmetric antenna pattern 1, a feed point 2 at one side of the glass plate and a defogging electric heating element provided with a pair of bus bars, one of which is divided into upper and lower bus bars 3 and 3' at one side.

However, even such a glass antenna has a drawback that it often exhibits sharp directivity when it receives a radio wave transmitted from a transmitting antenna of a radio broadcast station, under certain conditions. For instance, when it receives the radio wave at a place surrounded by tail buildings or at a place where an influence of a reflected wave is great, its non-directivity and sensitivity tends to be degraded. Namely, a ultra-short wave like a FM broadcast wave propagates linearly, and at a place surrounded by tall buildings or mountains, the radio wave transmitted from the radio station will be received by the receiving antenna, not directly but after reflected by such obstacles as the tall buildings or mountains. The plane of polarization of the radio wave propagated via such a complicated route tends to be distorted even when the plane of polarization of the transmitted wave is horizontal, i.e., the plane of polarization tends to incline toward a V-component (i.e., a vertical component).

The above mentioned antenna is designed primarily for a horizontally polarized wave which is most effective for improvement of the non-directivity for the FM broadcast wave. Accordingly, it tends to exhibit directivity with respect to the actual radio wave containing various polarized wave components, in the city or at a place surrounded by mountains, and the sensitivity is thereby reduced, for instance, in a case where the horizontally polarized wave component is weak and other polarized wave component such as a vertical wave component is strong, namely at a place where the ratio of the polarized wave components (i.e. H/V ratio, Hi 40 dBμ/m, Vi 30 dBμ/m) is 10 dBμ/m.

To improve the function for receiving a radio wave containing various polarized wave components, it is known to use a diversity antenna system wherein a plurality of antennas having different directivities are provided so that it is possible to selectively use one of the antennas which has better sensitivity and directivity against the particular radio wave received and containing various polarized wave components.

SUMMARY OF THE INVENTION

The present invention is based on a concept that the above mentioned drawback that the directivity of the glass antenna is degraded under certain circumstances, may be overcome by employment of such a diversity antenna system. The present invention provides a glass antenna which is most suitable for use in such a diversity antenna system.

Namely, the present invention provides a glass antenna system which comprises a main antenna disposed at an upper part of a glass plate for a rear window of an automobile and a defogging electric heating element disposed below and separate from the main antenna and comprising a plurality of heating strips and a pair of bus bars for supplying electricity to the heating strips, a wire is connected to a predetermined portion of the lower most heating strip among said heating strips and a feeding point for connection to an antenna feeder line is provided on the lead wire so that the defogging electric heating element constitutes a subsidiary antenna having directivity different from the directivity of the main antenna.

Thus, the glass antenna system of the present invention comprises a main antenna having high non-directivity and a subsidiary antenna having directivity different from the directivity of the main antenna, and accordingly it is possible to provide an antenna system having high non-directivity for any polarized wave component by properly selecting one of the main and subsidiary antenna showing a stronger antenna sensitivity for the given polarized wave.

DETAILED DESCRIPTION OF THE PREFERRED EMBODIMENTS

In the present invention, the pattern of the main antenna formed on or in the glass plate is appropriately selected depending upon the shape of the automobile, the size and shape of the glass plate, etc. so as to obtain the optimum antenna gain and non-directivity, and particularly the pattern is selected so as to obtain non-directivity for the radio wave having a horizontal plane of polarization. This main antenna is disposed on an upper part of the glass plate, i.e. an upper part of the glass plate fitted on the window frame of an automobile, preferably in a form of a combination of conductor strips. The antenna conductors constituting the main antenna may be designed to have a pattern to obtain high gains for both of FM and AM broadcast waves and to have the function for both of FM and AM broadcast bands. It is also possible to design them to have a pattern having a part for mainly receiving an AM broadcast wave and a part for mainly receiving a FM broadcast wave. It is further possible to design the antenna conductors to have a pattern having a part for receiving both of FM and AM broadcast waves and a part for mainly receiving AM broadcast wave.

Figure 1:
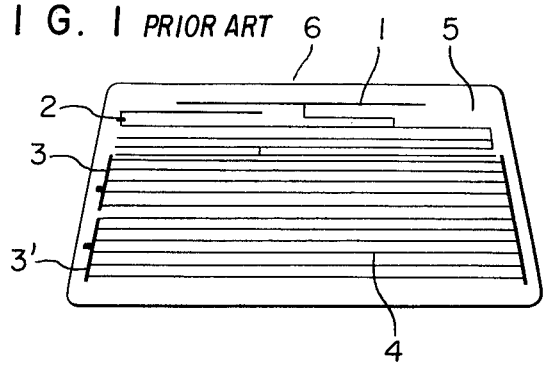
FIG. 1 PRIOR ART
FIG. 1 is a front view of a conventional glass antenna system for an automobile.
Figure 2:
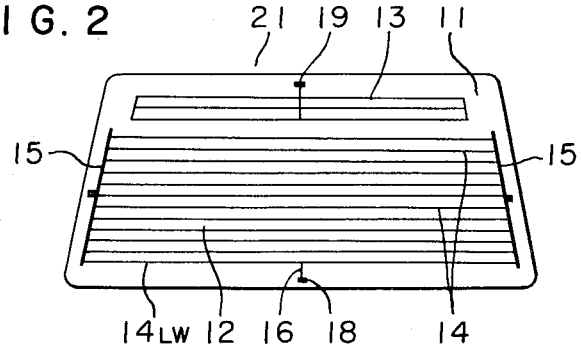
FIGS. 2 to 7 are respectively front views of various embodiments of the glass antenna system for an automobile according to the present invention.
Figure 3:
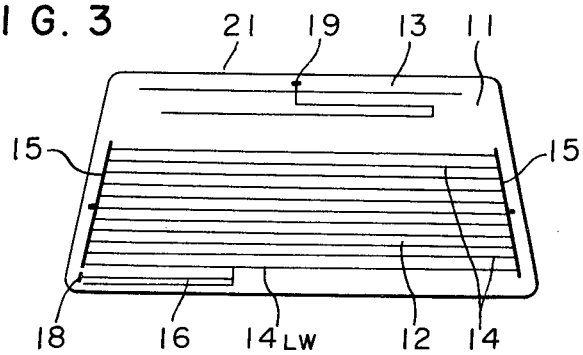

The pattern of this main antenna may be the one as shown in FIG. 2 wherein the main antenna 13 is composed of a combination of a plurality of strip antenna conductors disposed symmetrically above a defogging electric heating element 12 on a glass plate 11, or it may be the one as shown in FIG. 3 wherein the main antenna 13 is composed of a plurality of strip antenna conductors combined to present an asymmetric pattern relative to the vertical center line of the automobile and a feeding point for connecting an antenna feeder line is located at the center of the glass plate. It may further be the one as shown in FIGS. 4 to 7 wherein a plurality of strip antenna conductors are combined to present a pattern asymmetric to the vertical center line of the automobile, and the feeder point of the main antenna for connecting an antenna feeder line is located at either left or right side part of the glass plate.

The latter pattern of the main antenna is particularly preferred in that it is asymmetric to the vertical center line of the automobile and the feeding point of the main antenna is located at the transverse side part of the glass antenna, and accordingly it is thereby possible to shift the center line for the function of the antenna from the vertical center line of the automobile, for instance, the direction of the function of the antenna can be shifted for about 90° relative to the body of the automobile, whereby the 8-Fig. directivity characteristic having a dip point can effectivity be improved and the non-directivity can be improved.

Figure 4:
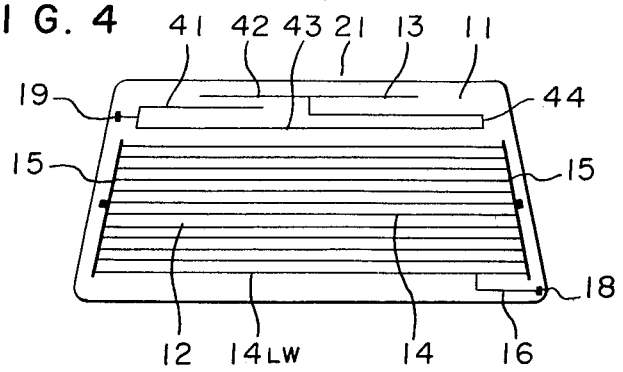
Figure 5:
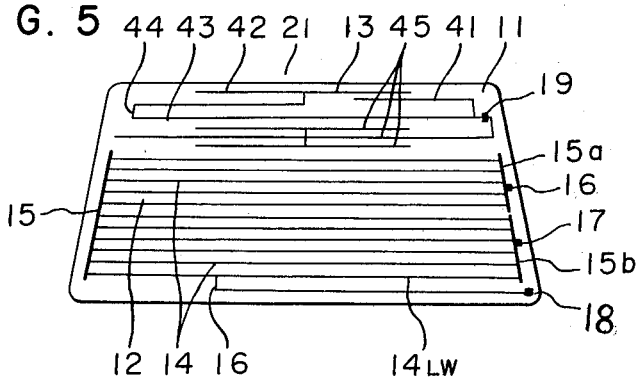
Figure 6:
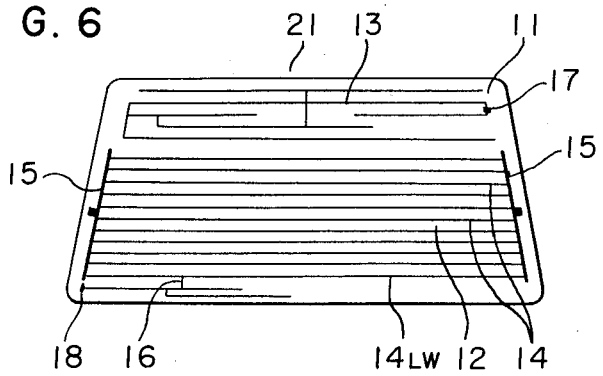
Figure 7:
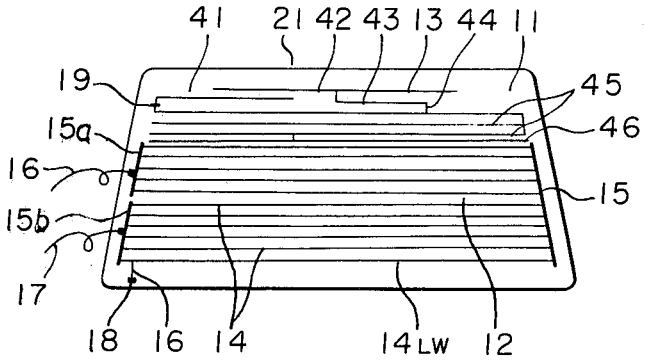

Among them, a main antenna having a pattern as shown in FIGS. 4, 5 and 7 may be mentioned as one of superior main antennas, wherein a main antenna strip 41 having a feeding point located at one side of the glass plate 11 is disposed transversely, an auxiliary antenna strip 42 is disposed with a space from the window frame and above the main antenna strip 41 with a predetermined space therefrom and it extends in a transverse direction of the glass plate 11, and a phase adjusting antenna strip 43 connecting the main antenna strip 41 to the auxiliary antenna strip 42 is provided.

Now, the pattern of this main antenna will be described. The main antenna strip 41 of this main antenna is disposed in a transverse direction of the glass antenna system 21 fitted on the rear window frame of the automobile and extends transverse from one side of the glass plate 11 to the center thereof and one end of the main antenna strip is connected to the feeding point 19 via lead wire and the other end opposite to the feeding point constitutes a free end. The length of the main antenna strip is preferably in a range of $(\lambda/4)\alpha\pm(\lambda/20)\alpha$ wherein $\lambda$ is a wavelength of desired middle frequency of the FM broadcast frequency band and $\alpha$ is a wavelength shortening coefficient of the glass antenna system. For example, it is preferably from 40 cm to 90 cm. Further, it is particularly preferred that the free end of the main antenna strip 41 is located at about the center region of the glass antenna. The main antenna strip 41 is not limited to a straight strip as shown in FIGS. 4, 5 and 7, and may be made of a plurality of strips or may be curved.

The above mentioned auxiliary antenna strip 42 is disposed with a space from the window frame above the main antenna strip 41 with a predetermined space from the main antenna strip and extends in a transverse direction of the glass plate 11. This auxiliary antenna strip 42 may be disposed below the main antenna strip 41. The space between the main antenna strip 41 and the auxiliary antenna strip 42 is preferably from 1 to 3 cm as a parallel space, particularly from the viewpoint of the receiving sensitivity. When the auxiliary antenna strip 42 is disposed in the vicinity of the window frame, it is preferred the strip is spaced from the window frame for a distance of 1 to 5 cm. As shown in FIGS. 4, 5 and 7, this auxiliary antenna strip 42 is most preferably disposed at an upper center part of the glass plate 11 in a symmetrical pattern in the transverse direction with its both ends consituting free ends. However, the auxiliary antenna strip 42 may not necessarily have two free ends, and it may have one free end. Further, the auxiliary antenna strip may be disposed at a side part of the glass plate instead of the center part. Further, the pattern of the auxiliary antenna strip 42 is not limited to the specific pattern illustrated in the drawings and the length, pattern and the number of strips may optionally be chosen depending upon the shape of the automobile, the shape and size of the glass plate, the pattern of other antenna strips or various other factors.

The phase adjusting antenna strip 43 serves to adjust the phase to the FM broadcast wave at the feeding point 19 of the main antenna strip 41 and the auxiliary antenna strip 42 which have different directivity characteristics and to composite the main antenna strip 41 and the auxiliary antenna strip 42 in the optimum condition and assists to increase the sensitivity for receiving the AM broadcast wave. The length of the phase adjusting antenna strip 43 is selected to adjust the phase of the receiving wave region. The phase adjusting antenna strip 43 connects the feeding point of the main antenna strip 41 to the auxiliary antenna strip 42. For instance, the length of the phase adjusting antenna strip 43 is selected to resonate to the FM broadcast frequency band (76 to 90 MHz). In particular, the length is selected to be $\lambda/4$, $(\frac{3}{4})\lambda$, $(5/4)\lambda$ . . . $(n/4)\lambda$ wherein $\lambda$ is a wavelength of central frequency of the FM broadcast frequency band and n is an odd number. It is preferable in practice that the length is within a range of $\lambda/4\pm\lambda/20$, $(\frac{3}{4})\lambda\pm\lambda/20$ . . . $(n/4)\lambda\pm\lambda/20$.

It is likewise preferred that the above mentioned phase adjusting antenna 43 has an asymmetrical pattern to the vertical center line of the glass plate, and the transverse portion of the phase adjusting antenna strip 41 is stepped with a predetermined space from the transverse portions of the above mentioned main antenna strip 41 and auxiliary antenna strip 42 and extends substantially in parallel with those strips.

As shown in FIGS. 4, 5 and 7, the pattern of the phase adjusting antenna strip 43 may have a bent part 44. The phase adjusting antenna strip 43 is connected to the main antenna strip 41 so as not to impair the receiving sensitivity of the main antenna strip and the directivity of the FM broadcast wave. For instance, the phase adjusting antenna strip 43 is most preferably connected to the part of the main antenna strip 41 in the vicinity of the feeding point 19, which part is not the main functional part of the main antenna strip. Likewise, the phase adjusting antenna strip 43 is connected to the auxiliary antenna strip 42 so as not to impair the receiving sensitivity of the auxiliary antenna strip 42 and the directivity characteristics of the FM broadcast wave. For instance, it is preferred that the phase adjusting antenna strip 43 is connected to the central part or near the end part of the auxiliary antenna strip 42.

The feeding point 19 for connecting the main antenna strip 41 is preferably provided at either left or right side of the glass plate. However, it may be provided at an upper part or a certain other proper part of the glass plate depending upon the design.

When the AM broadcast receiving function is not sufficient by use of only these antenna strips, an additional antenna strip 45 for the AM broadcast wave as shown in FIGS. 5 and 7 may be provided.

Further, as shown in FIG. 7, a connected strip 46 may be provided which is close to the upper most heating strip of the defogging electric heating element but spaced therefrom for a distance of e.g. from 1 to 10 mm and which is connected to the AM antenna strip 45, whereby the defogging electric heating element is utilized as an antenna to increase the gain for the FM broadcast wave and the non-directivity and/or to increase the gain for the AM broadcast wave.

In the glass antenna system for an automobile according to the present invention, a defogging heating element is provided below the above mentioned main antenna to heat the glass plate and thereby to prevent the fogging due to the formation of dew drops on the glass plate. This heating element comprises a plurality of heating strips and bus bars for supplying electricity to the heating strips.

For instance, a typical defogging electric heating element formed on the glass plate is illustrated in FIGS. 2 to 7 in which the defogging electric heating element comprises a plurality of heating strips 14 having a width of from 0.5 to 2 mm and arranged in a transverse direction of the glass plate 11 substantially in parallel with one another with a space of from 2 to 4 cm, and bus bars 15 connected to the feeding ends of the heating strips 14. However, the defogging electric heating element to be used in the present invention is not limited to this specific example.

In order to increase the non-directivity as an antenna, this defogging electric heating element 12 is preferably designed as illustrated in FIGS. 5 and 7 in which the pattern of the current circuit of the defogging electric heating element 12 has a ⊐-shape, namely, one of the opposing bus bars 15 is divided into two bus bars **15*a* and 15*b* and lead wires 16 and 17 are connected to them, respectively, so that the current supplied passes from the bus bar 15*a* or 15*b* via the bus bar 15 to the bus bar 15*b* or 15*a* in the ⊐-shape. However, the defogging electric heating element 12 may be the one as shown in FIGS. 2, 3, 4 and 6 in which bus bars 15** are connected at both ends of the heating strips or the one in which bus bars are further divided into a plurality of bus bars so that the current can flow in a zig-zag fashion.

The relative positioning of the defogging electric heating element and the main antenna may be such that they are spaced from each other with a sufficient distance of e.g. at least 1 cm, preferably at least 2 cm so that the defogging electric heating element does not affect the main antenna in either a direct current fashion or a high frequency fashion, or in order to positively utilize the defogging electric heating element for improvement of the non-directivity and gain for FM or for improvement of the gain for AM, the main antenna is disposed close to the defogging electric heating element, e.g. with a distance of from 0.1 to 1.0 cm, preferably from 0.1 to 0.5 cm so that they are connected to each other in terms of the high frequency. If the main antenna and the defogging electric heating element as the subsidiary antenna are directly connected, the main antenna and the subsidiary antenna become integral and they will not perform the respective functions as the main antenna and the subsidiary antenna having different directivities. Therefore, the direct connection should be avoided.

A glass antenna system of the former type is illustrated in FIGS. 2 to 6 wherein the main antenna and the defogging electric heating element are spaced for a distance of from 2 to 5 cm. A glass antenna system of the latter type is illustrated in FIG. 7 wherein the main antenna and the defogging electric heating element are disposed closely to each other with a space of from 0.1 to 0.5 cm so as to establish the high frequency connection to each other.

The glass antenna system of the present invention comprises a subsidiary antenna in addition to the above mentioned main antenna so that it can be applied to a diversity antenna system. For such a subsidiary antenna, the above mentioned defogging electric heating element is advantageously utilized also as an antenna by providing a lead wire to the lower most heating strip of the defogging electric heating element and further providing a feeding point for connecting an antenna feeder line, to the lead wire.

The antenna pattern of this subsidiary antenna should preferably be such that it has a high gain at a region where the directivity of the main antenna is reduced, i.e. it has directivity characteristics complementary to the directivity characteristics of the main antenna. For instance, it is a pattern having characteristics to exhibit the dip point in a different direction.

The lead wire for the above subsidiary antenna is selected for its length, pattern and position for connection to the lower most heating strip of the defogging electric heating element so as to provide a directivity different from the main antenna, to give a good gain over the entire FM frequency band, to minimize the f characteristics (i.e. a fluctuation of the gain depending upon the frequency) and not to affect the performance of the main antenna. For instance, as shown in FIGS. 3 to 7, a lead wire 16 is connected to the side part of the lower most strip $\mathbf{14}_{LW}$ of the heating strips 14 on the glass plate 11, or as shown in FIG. 2, a lead wire 16 is connected to the center part of the lower most strip $\mathbf{14}_{LW}$ or the heating strips 14 on the glass plate 11. The lead wire may be straight or curved, or it may be a wire having a bent portion as shown in FIGS. 3, 4 or 5. Or a plurality of wires may be combined, or a part of the lead wire may be extended. This lead wire is provided at its end or center with a feeding point 18 for connecting an antenna feeder line for the output of the signal.

The heating strips and bus bars are made of conductive materials, and accordingly, the defogging electric heating element provided with the lead wire can be made functionable as an antenna by connecting an antenna feeder line to the feeding point 18.

With respect to the directivity of the subsidiary antenna wherein the signal is withdrawn from a point on the lower most heating strip of the defogging electric heating element, the probability that the directivities of the main antenna and the subsidiary antenna coincide with each other in various depolarized wave component ratios (H/V ratios) is extremely low because of the difference in the positioning of the main antenna, the difference in the positioning of the main antenna, the difference in the antenna pattern and the influence of the reflected wave from the body of the automobile. Accordingly, the subsidiary antenna can readily be prepared.

In the application of the glass antenna system of the present invention to a diversity antenna system, a switching means is provided which is capable of selecting any one of the antenna outputs from the two antennas, i.e. the main antenna and the subsidiary antenna.

In the glass antenna system of the present invention, it is preferred to connect a high frequency amplifying circuit to the main antenna or the subsidiary antenna, or both of them so as to increase the receiving sensitivity to the AM and FM broadcast waves or to increase the receiving sensitivity to the AM broadcast wave. Further, on the power source side of the defogging electric heating element, a high frequency choke coil or a rectifier may be inserted to cut a direct current which causes noise and to permit the heating element to function properly as an antenna.

The conductors for the main antenna and the subsidiary antenna according to the present invention are formed typically in a strip-shape by printing on the glass surface a conductive paste prepared by mixing and suspending a conductive metal powder (e.g. silver powder), low melting glass frits, a vehicle and other optional components to form a predetermined pattern and baking the printed paste, and, if necessary, further subjecting it to plating treatment. However, the antenna conductors may, of course, be made of a conductive slender metal wire. When such a metal wire is used, it is embedded in an intermediate film, which is then sandwiched between a pair of glass sheets to obtain a laminated glass.

Figure 8:
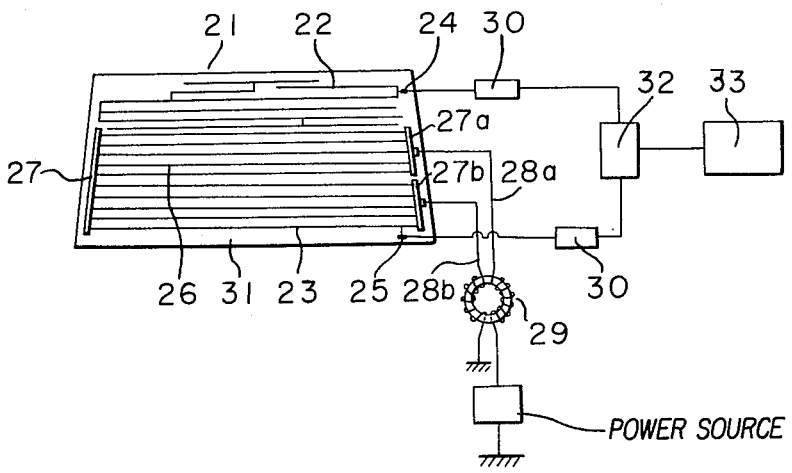
FIG. 8 is a diagrammatic view of a diversity antenna system in which the glass antenna system for an automobile according to the present invention is incorporated.

FIG. 8 is a diagrammatic view of a diversity antenna system wherein the glass antenna system of the present invention is incorporated. In the Figure, reference numeral 21 designates a glass antenna system, numeral 22 designates the main antenna of this glass antenna system, numeral 23 designates the subsidiary antenna, numeral 24 designates the feeding point of the main antenna and numeral 25 designates the feeding point of the subsidiary antenna. One of the bus bars of the defogging electric heating element 26 consitituting the subsidiary antenna 23 is divided into two parts i.e. bus bars 27*a* and 27*b*. Lead wires 28*a* and 28*b* for a power source are connected to the bus bars 27*a* and 27*b*, respectively, and a choke coil 29 is inserted between the bus bars and grounding for isolating the defogging electric heating element for high frequency so that the radio wave induced in the heating element will be input to the radio receiver without loss. As the high frequency choke coil, an in-phase winding choke coil is used and one of the windings of the choke coil is connected to the bus bar 26*a* and the other winding is connected to the bus bar 26*b*, respectively in series.

A high frequency amplifying circuit 30 is inserted between the feeding point 24 of the main antenna 22 and the input terminal of the radio receiver to increase the gains of the receiving signals of the AM and FM broadcast waves.

A switching circuit 32 to receive two signals from the main antenna and the subsidiary antenna and to select a stronger signal, is connected to the main antenna 22 and the subsidiary antenna 23, and the received signal of the main antenna or the subsidiary antenna selected by this switching circuit 32 will be input to the radio receiver 33. This switching circuit 32 may be provided between the high frequency amplifying circuits 30 for the main antenna and the subsidiary antenna and the radio receiver 33 as shown in FIG. 8 or it may be provided between the main antenna and the subsidiary antenna, and the high frequency amplifying circuits. The switching circuit may not necessarily be provided before the input of the radio receiver, and it may be provided at any appropriate position in the circuit of the radio receiver, such as a high frequency amplifying stage (RF stage) or a low frequency amplifying stage (AF stage) of the radio receiver.

In the antenna system employing the glass antenna system of the present invention, the main antenna and the subsidiary antenna function to complement each other to receive magnetic wave having any depolarized wave components, and thus the antenna system has no substantial directivity, whereby extremely good receiving characteristics are obtainable.

The present invention has been described with respect to a glass antenna system for an automobile comprising one main antenna and one subsidiary antenna. However, in addition to the main antenna and the subsidiary antenna, there may further be provided at least one main antenna, main antenna and subsidiary antenna, or subsidiary antenna, at an appropriate portion of the same glass antenna system.

Now, the present invention will be described in further detail with reference to Example.

EXAMPLE 1

Figure 10:
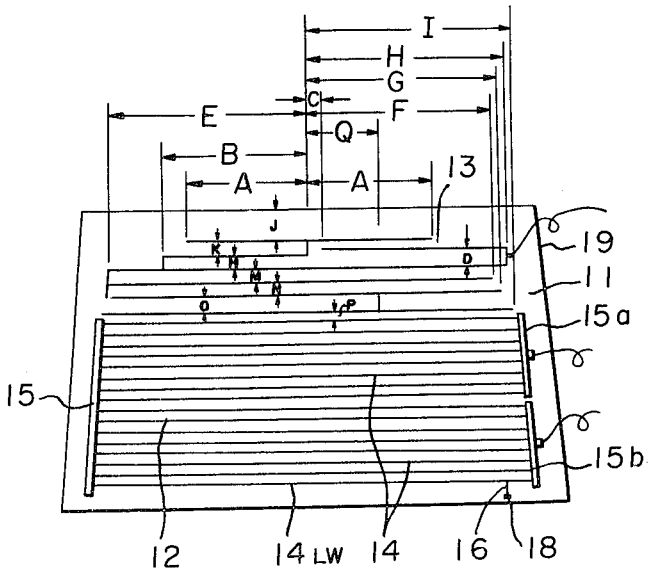
FIG. 10 is a front view of the glass antenna system for an automobile according to the Example.
Figure 11:
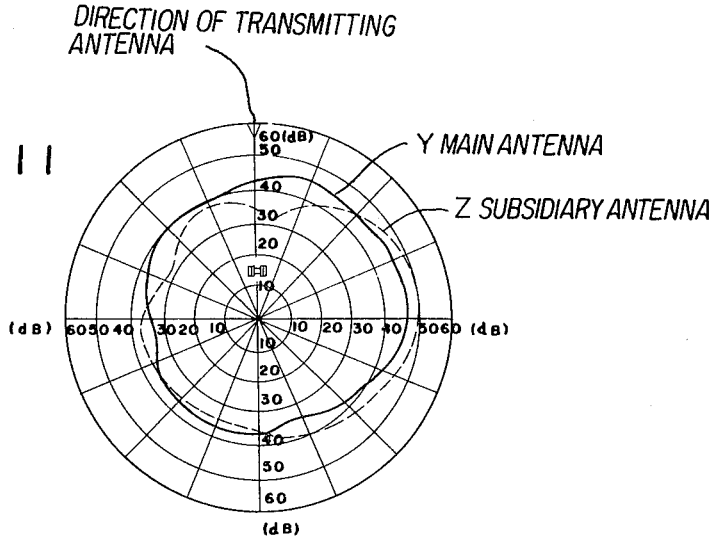
FIGS. 11 to 16 are respectively directivity characteristic distribution diagrams of the glass antenna for an automobile according to the Example.
Figure 12:
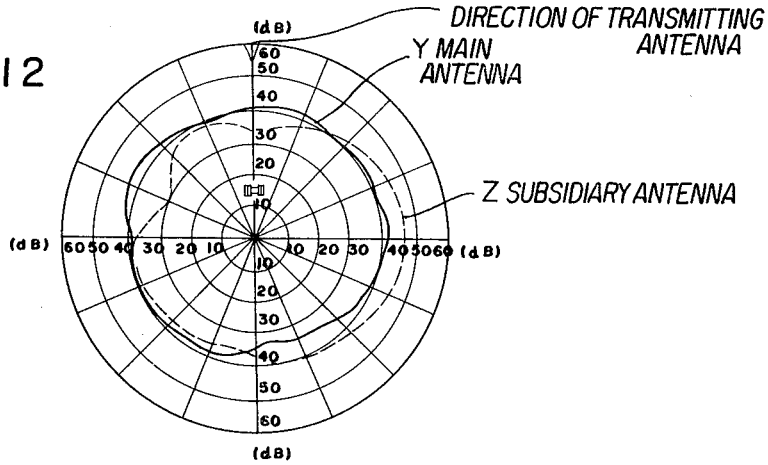
Figure 13:
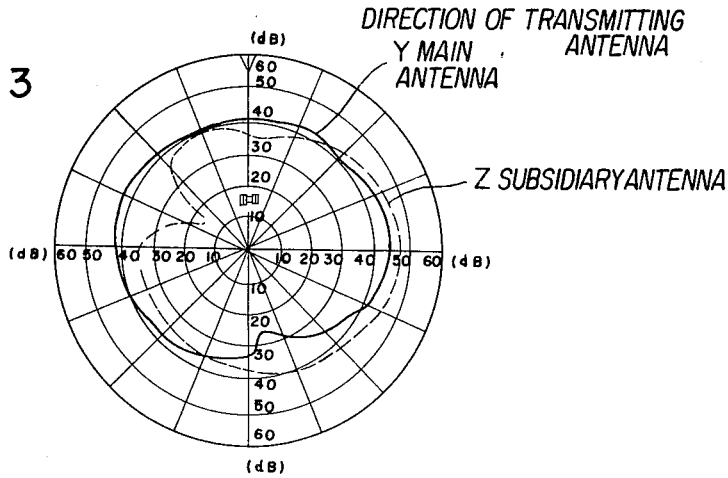
Figure 14:
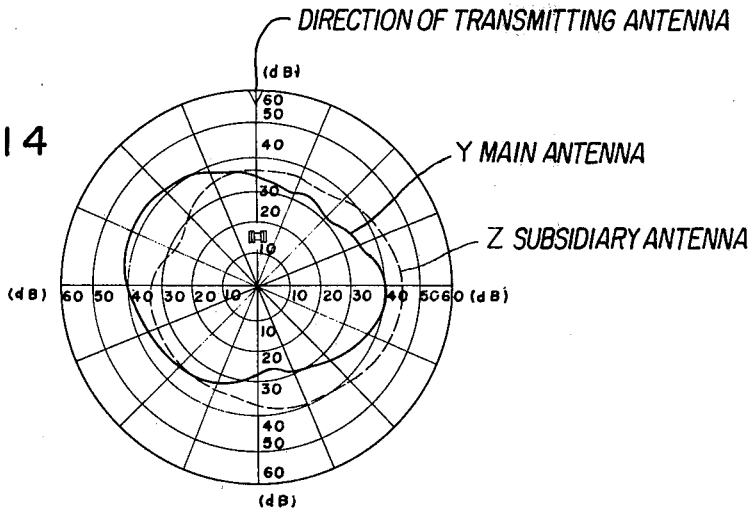
Figure 15:
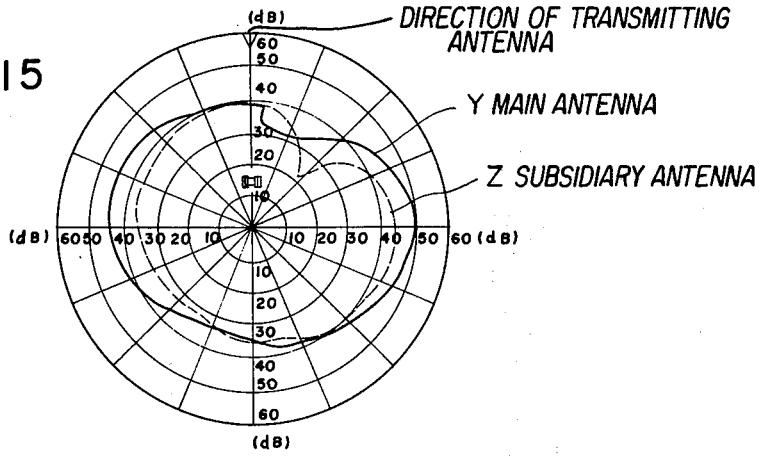
Figure 16:
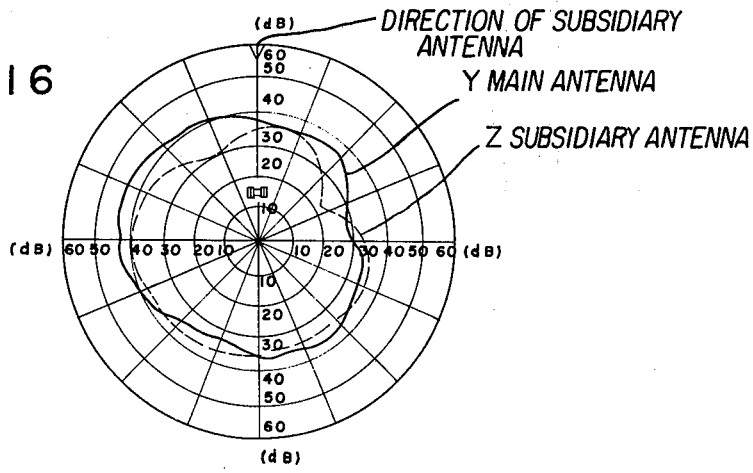

A silver paste was screen-printed on a glass plate surface to form patterns of the main antenna and the subsidiary antenna as shown in FIG. 10, then dried and baked to obtain a glass antenna system. The dimensions of various parts of this glass antenna system were as follows:

| | | |
|---|---|---|
| A = 310 mm | B = 280 mm | C = 110 mm |
| D = 35 mm | E = 575 mm | F = 570 mm |
| G = 575 mm | H = 550 mm | I = 540 mm |
| J = 40 mm | K = 25 mm | L = 20 mm |
| M = 20 mm | N = 20 mm | O = 20 mm |
| P = 5 mm | Q = 50 mm | |

The average gains, the minimum values among the gains in various directions and the directivities (i.e. the average gain—the minimum gain) of each of the main antenna and the subsidiary antenna of this glass antenna system were measured at various frequencies i.e. every 1 M Hz frequency ranging from 76 M Hz to 90 M Hz with respect to a radio wave having a horizontal plane of polarization. The results thereby obtained are shown in Table 1.

TABLE 1

| Antenna | f(MHz) | | | | | | | | | | | | | | |
|---|---|---|---|---|---|---|---|---|---|---|---|---|---|---|---|
| Items | 76 | 77 | 78 | 79 | 80 | 81 | 82 | 83 | 84 | 85 | 86 | 87 | 88 | 89 | 90 |
| Main antenna | | | | | | | | | | | | | | | |

TABLE 1-continued

| Antenna Items | f(MHz) 76 | 77 | 78 | 79 | 80 | 81 | 82 | 83 | 84 | 85 | 86 | 87 | 88 | 89 | 90 |
|---|---|---|---|---|---|---|---|---|---|---|---|---|---|---|---|
| Average values | 38.6 | 38.2 | 38.0 | 38.6 | 39.8 | 41.4 | 41.6 | 42.2 | 42.2 | 42.4 | 44.4 | 44.6 | 44.6 | 44.6 | 43.0 |
| Minimum values | (34.4) | (33.6) | (33.1) | (33.9) | (35.2) | (37.2) | (36.4) | (36.6) | (37.1) | (36.6) | (39.7) | (39.0) | (39.0) | (38.4) | (35.1) |
| Directivities | 4.2 | 4.6 | 4.9 | 4.7 | 4.6 | 4.2 | 5.2 | 5.6 | 4.6 | 5.8 | 4.7 | 5.6 | 5.6 | 6.2 | 7.9 |
| Subsidiary antenna | | | | | | | | | | | | | | | |
| Average values | 37.6 | 37.2 | 38.4 | 38.6 | 39.6 | 40.4 | 41.0 | 41.6 | 41.8 | 42.0 | 42.0 | 42.2 | 42.4 | 43.4 | 44.2 |
| Minimum values | (31.5) | (30.7) | (28.0) | (13.9) | (26.5) | (32.5) | (33.7) | (34.6) | (34.9) | (34.2) | (33.8) | (33.6) | (19.1) | (29.2) | (30.9) |
| Directivities | 6.1 | 6.5 | 10.4 | 24.7 | 13.1 | 7.9 | 7.3 | 7.0 | 6.9 | 7.8 | 8.2 | 8.6 | 23.3 | 14.1 | 13.3 |

(unit: dB)

Then, with respect to radio waves having various planes of polarization inclined at certain angles from the horizontal plane, the directivities (i.e. the average gain—the minimum gain) of each of the main antenna and the subsidiary antenna of the above glass antenna system were measured at 15 different frequencies, i.e. every 1 M Hz ranging from 76 M Hz to 90 M Hz. The average values of the directivities of the higher antenna gains at the respective 15 frequencies were obtained. For the purpose of comparison, the average values of the directivities of the main antenna only, at the respective 15 frequencies were obtained. The results thereby obtained are shown in Table 2.

TABLE 2

| Angles from the horizontal plane of polarization | 0° | 10° | 22.5° | 45° | 67.5° | 90° |
|---|---|---|---|---|---|---|
| Measured circle H/V radio (dB) | about 20 | about 10 | about 3 | about −3 | about −10 | about −25 |
| Glass antenna system of the invention (Main and subsidiary antennas) (dB) | | | | | | |
| Average values of the directivities at 15 frequencies | 3.8 | 4.5 | 6.0 | 7.7 | 10.5 | 5.3 |
| Comparative Example (Main antenna only) (dB) | | | | | | |
| Average values of the directivities at 15 frequencies | 5.2 | 7.2 | 9.9 | 11.1 | 27.5 | 19.8 |

With respect to radio waves having various planes of polarization inclined at certain angles from the horizontal plane of polarization, the frequency within a range of from 76 to 90 M Hz at which the best directivity was obtained and the directivity and the minimum gain at that time are shown in Table 3. Likewise the frequency within a range of from 76 to 90 M Hz at which the worst directivity was obtained and the directivity and the minimum gain at that time are shown in Table 4.

TABLE 3

| Angles from the horizontal plane of polarization | | | 0° | 10° | 22.5° | 45° | 67.5° | 90° |
|---|---|---|---|---|---|---|---|---|
| Measured circle H/V ratio (dB) | | | about 20 | about 10 | about 3 | about −3 | about −10 | about −25 |
| Glass antenna system of the invention (Main and subsidiary antennas) | The best directivity among 15 frequencies was obtained at: | Frequency: (MHz) | 79 | 79 and 80 | 80 | 90 | 77 and 81 | 83 |
| | | Directivity: (dB) | 1.6 | 2.4 | 1.4 | 3.2 | 7.0 | 2.4 |
| | | Minimum gain: (dB) | 37 | 36 and 37 | 38 | 38 | 32 and 35 | 38 |
| Comparative Example (Main antenna only) | The best directivity among 15 frequencies was obtained at: | Frequency: (MHz) | 76 and 81 | 76 | 77 | 77 | 76 | 81 |
| | | Directivity: (dB) | 4.2 | 4.1 | 5.7 | 6.0 | 12.1 | 8.4 |
| | | Minimum gain: (dB) | 34.4 and 37.2 | 34.7 | 31.3 | 32.4 | 27.7 | 33.2 |

TABLE 4

| Angles from the horizontal plane of polarization | | | 0° | 10° | 22.5° | 45° | 67.5° | 90° |
|---|---|---|---|---|---|---|---|---|
| Measured circle H/V ratio (dB) | | | about 20 | about 10 | about 3 | about −3 | about −10 | about −25 |
| Glass antenna system of the | The worst directivity among 15 frequencies | Frequency: (MHz) | 87 and 88 | 86 and 87 | 86 and 87 | 87 | 85 | 80 |
| | | Directivity: | 5.6 | 6.2 | 8.3 | 12.4 | 23.9 | 10.8 |

TABLE 4-continued

| Angles from the horizontal plane of polarization | | | 0° | 10° | 22.5° | 45° | 67.5° | 90° |
|---|---|---|---|---|---|---|---|---|
| invention (Main and subsidiary antennas) | was obtained at: | (dB) Minimum gain: (dB) | 39.0 | 37.8 and 38.0 | 36.9 and 37.1 | 32 | 18.3 | 28 |
| Comparative Example (Main antenna only) | The worst directivity among 15 frequencies was obtained at: | Frequency: (MHz) | 90 | 90 | 78 | 88 | 82 | 86 |
| | | Directivity: (dB) | 7.9 | 15.6 | 13.6 | 16.5 | 30.0 | 33.8 |
| | | Minimum gain: (dB) | 35.1 | 26.8 | 24.4 | 27.7 | 11.0 | 10.2 |

In each of the above Tables, the smaller the value of the directivity, i.e. the smaller the difference between the average gain and the minimum gain at a given frequency, the better the non-directivity characteristic.

Figure 9:
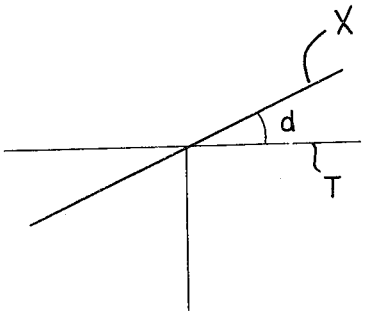
FIG. 9 is a diagrammatic view illustrating the method of measurement used in the Example.

Referring to FIG. 9, the transmitting antenna X was inclined at an angle $\alpha$ (in this case, $\alpha$ wes 0°, 10°, 22.5°, 45°, 67.5°, and 90°) from the horizontal plane T, and the directivity characteristics of the main antenna and the subsidiary antenna of the glass antenna system were measured at each angle. The results thereby obtained are shown in FIGS. 11 to 16. The measurements were carried out at a uniform electric field of 60 dB for a radio wave having a frequency of 80 M Hz. FIGS. 11, 12, 13, 14 and 15 are directivity characteristic diagrams obtained at an angle $\alpha$ of 10°, 22.5°, 45°, 67.5° and 90°, respectively. In the Figures, Y and Z represent the directivity characteristic curves of the main antenna and the subsidiary antenna, respectively.

As is apparent from these directivity characteristic diagrams, it is always possible to obtain superior non-directivity by selecting the stronger signal from the two signals i.e. either the main antenna signal or the subsidiary antenna signal when a radio wave having any polarized wave component is received.

We claim:

1. A glass antenna system for an automobile which comprises a main antenna disposed at an upper part of a glass plate for a rear window of the automobile, said main antenna being connected to a first antenna feeder line, a defogging electric heating element disposed below and separate from the main antenna and comprising a plurality of heating strips, a pair of bus bars for supplying electricity to the heating strips, a lead wire connected to a predetermined portion of the lowermost of said heating strips, a feeding point for connection to an antenna feeder line provided on the lead wire, and a second antenna feeder line connected to said feeding point whereby the defogging electric heating element constitutes a subsidiary antenna having a directivity different from the directivity of the main antenna.

2. The glass antenna system for an automobile according to claim 1 wherein the main antenna has a pattern asymmetric to the vertical center line of the glass plate.

3. The glass antenna system for an automobile according to claim 1 wherein the main antenna has a pattern asymmetric to the vertical center line of the glass plate and the feeding point of the main antenna for connection to said first antenna feeder line is disposed at either one of the side parts of the glass plate.

4. The glass antenna system for an automobile according to claim 1 wherein one of the pair of bus bars is divided into an upper bus bar and a lower bus bar, and a power source lead wire is connectable to each of the upper and lower bus bars.

5. The system of claim 1 including a switching circuit, said first and second antenna feeder lines being connected to said switching circuit.

6. The system of claim 5 wherein said switching circuit is constructed for selection of the stronger signal from said antenna feeder lines.

7. The system of claim 4 including a high frequency choke in said power source lead wire, whereby a signal from said subsidiary antenna is isolated from noise generated by a power source.

* * * * *